US006669799B2

(12) United States Patent
Putnam et al.

(10) Patent No.: US 6,669,799 B2
(45) Date of Patent: Dec. 30, 2003

(54) DURABLE AND DRAPEABLE IMAGED NONWOVEN FABRIC

(75) Inventors: Michael J. Putnam, Fuquay-Varina, NC (US); Herbert P. Hartgrove, Angier, NC (US); Robert Gregory Rabon, Clayton, NC (US)

(73) Assignee: Polymer Group, Inc., No. Charleston, SC (US)

( * ) Notice: Subject to any disclaimer, the term of this patent is extended or adjusted under 35 U.S.C. 154(b) by 0 days.

(21) Appl. No.: 09/766,443

(22) Filed: Jan. 19, 2001

(65) Prior Publication Data

US 2002/0002764 A1 Jan. 10, 2002

Related U.S. Application Data

(60) Provisional application No. 60/177,150, filed on Jan. 20, 2000.

(51) Int. Cl.[7] ..... B32B 31/16; B32B 31/26; D04H 1/48; D04H 1/58

(52) U.S. Cl. ..... 156/148; 156/181; 156/308.2; 28/104; 28/105; 264/113; 264/122

(58) Field of Search ..... 28/104, 105; 156/148, 156/181, 308.2; 264/113, 122

(56) References Cited

U.S. PATENT DOCUMENTS

| | | | | | |
|---|---|---|---|---|---|
| 4,214,582 | A | * | 7/1980 | Patel | 602/43 |
| 5,240,764 | A | * | 8/1993 | Haid et al. | 28/104 |
| 5,254,396 | A | | 10/1993 | Takemura et al. | |
| 5,375,306 | A | * | 12/1994 | Roussin-Moynier | 28/104 |
| 5,396,689 | A | * | 3/1995 | Vuillaume | 28/103 |
| 5,413,849 | A | * | 5/1995 | Austin et al. | 428/293 |
| 5,431,991 | A | * | 7/1995 | Quantrille et al. | 156/163 |
| 5,822,833 | A | * | 10/1998 | James et al. | 28/105 |

* cited by examiner

*Primary Examiner*—Sam Chuan Yao
(74) *Attorney, Agent, or Firm*—Wood, Phillips, Katz, Clark & Mortimer

(57) ABSTRACT

A nonwoven fabric, and method of production, are disclosed, wherein the nonwoven fabric comprises textile length fibers with a portion being thermally fusible. The fabric exhibits sufficient durability to withstand commercial dyeing processes, with the resultant fabric finding widespread applicability by virtue of its durability and aesthetic appeal.

7 Claims, 6 Drawing Sheets

-ALL DIMS. (mm).
-ALL DIMS. APPROX.

SECT. A-A

-ALL DIMS. (mm)
-ALL DIMS. APPROX.

DURABLE AND DRAPEABLE IMAGED NONWOVEN FABRIC

CROSS REFERENCE TO RELATED APPLICATION

This application claims the benefit of Provisional Application Ser. No. 60/177,150, filed Jan. 20 , 2000.

TECHNICAL FIELD

The present invention relates generally to nonwoven fabrics and their method of production, and more particularly to a process for making stabilized, highly durable hydroentangled webs, comprising a blend of textile length fibers where a portion of same are thermally fusible, and where such fabrics are suitable for commercial dyeing operations, most particularly jet-dye processes.

BACKGROUND OF THE INVENTION

Nonwoven fabrics are used in a wide variety of applications where the engineered qualities of the fabric can be advantageously employed. These types of fabrics differ from traditional woven or knitted fabrics in that the fabrics are produced directly from a fibrous mat eliminating the traditional textile manufacturing processes of multi-step yarn preparation, and weaving or knitting. Entanglement of the fibers or filaments of the fabric acts to provide the fabric with a substantial level of integrity. However, the required level of fabric integrity when such fabrics are used in highly abrasive environments is not possible by entanglement alone, and thus it is known to apply binder compositions or the like to the entangled fabrics for further enhancing the integrity of the structure.

U.S. Pat. No. 3,485,706, to Evans, hereby incorporated by reference, discloses processes for effecting the hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing fabrics with the desired physical properties as well as an aesthetically pleasing appearance.

In general, hydroentangled fabrics formed on the above type of three-dimensional image transfer devices exhibit sufficient strength and other requisite physical properties as to be suitable for a number of textile applications.

However, many desired applications have requirements for commercial dyeing and wash durability, which are generally beyond the design capability of such fabrics. Typically, home or commercial laundering or the rigors of commercial dye house processes have a deleterious effect on these hydroentangled or imaged fabrics. The clarity of the raised image is reduced or "washed out" and the fabric surface becomes abraded with fibers forming pills on the fabric surface. Physical strength characteristics can also be reduced.

Heretofore, chemical binder systems have been developed that provide high abrasion resistance to nonwoven, woven or knitted fabrics. Other binder compositions can provide durability to laundering and commercial dyeing processes. However, it will be appreciated that application of chemical binders also increases the complexity of the fabric manufacturing process and adds cost to the fabric thus produced. The use of such compositions also requires specialized equipment to mix and apply the binder formulations as well as to dry and cure the binder compositions after application to the fabrics.

The addition of binder compositions has an effect on the fabric properties. The use of such binders generally produces fabrics which are stiffer than like fabrics produced without the binder application. Such stiffness will be recognized as being undesirable for apparel fabrics, where softness, suppleness and drapeability are highly preferred.

SUMMARY OF THE INVENTION

The present invention is directed to a process for making nonwoven fabrics which exhibit the desired durability to commercial dye house processing, most particularly jet-dye processing, as well as acceptable softness and drapeability. This is achieved by the inclusion of fusible fibers, preferably in the form of bicomponent fibers, most preferably nylon or polyester bicomponent fibers, into the fibrous matrix of the substrate web. Such fibers, when the entangled and patterned web is subjected to temperatures above the melting point of the lower melting component of the bicomponent fibers, acts to provide enhanced mechanical stability to the fibrous matrix of the web. An imaged nonwoven fabric with this added degree of mechanical stabilization has been found to be durable to commercial dye house processing, in particular to the mechanically aggressive jet-dye processing, and able to retain the imparted image quality under harsh mechanical conditions.

A process for making a jet-dye process-durable nonwoven fabric in accordance with the present invention comprises the steps of providing a fibrous matrix to form a precursor web comprised of a blend of textile length fibers where at least a portion of those fibers are bicomponent, thermoplastic fibers. The fibrous component of the precursor web can be in the form of a fibrous batt or matrix containing a single homogenous blend of fusible fibers or in a layered fibrous batt having either the same or different fusible fiber blend ratios in each fibrous batt sub-layer, with the matrices consolidated to form the precursor web. The precursor web is positioned on a three-dimensional image transfer device with hydroentangling of the precursor web on the image transfer device effected to form an entangled and imaged web, with the image transfer device imparting the fibrous matrix with a three-dimensional spatial arrangement.

Subsequent to the hydroentanglement and imaging of the web, the temperature of the web is elevated, such as during drying of the web, so that the lower melting point component of the bicomponent fusible fibers is softened or melted and acts to thermally bond fibers in the web together. The three-dimensional spatial arrangement of the fibrous matrix is thus secured. This results in an enhanced mechanical stability such that the highly durable fabric of the present invention is capable of being commercially dyed, without deleterious effects on aesthetic or physical properties. The commercial dye processing produces, as the final product, a colored, highly durable, imaged nonwoven fabric.

Other features and advantages of the present invention will become readily apparent from the following detailed description, the accompanying drawings and the appended claims.

BRIEF DESCRIPTION OF THE DRAWINGS

The invention will be more easily understood by a detailed explanation of the invention including drawings. Accordingly, drawings which are particularly suited for explaining the invention are attached herewith; however, is should be understood that such drawings are for explanation purposes only and are not necessarily to scale. The drawings are briefly described as follows.

DETAILED DESCRIPTION

Figure 1:
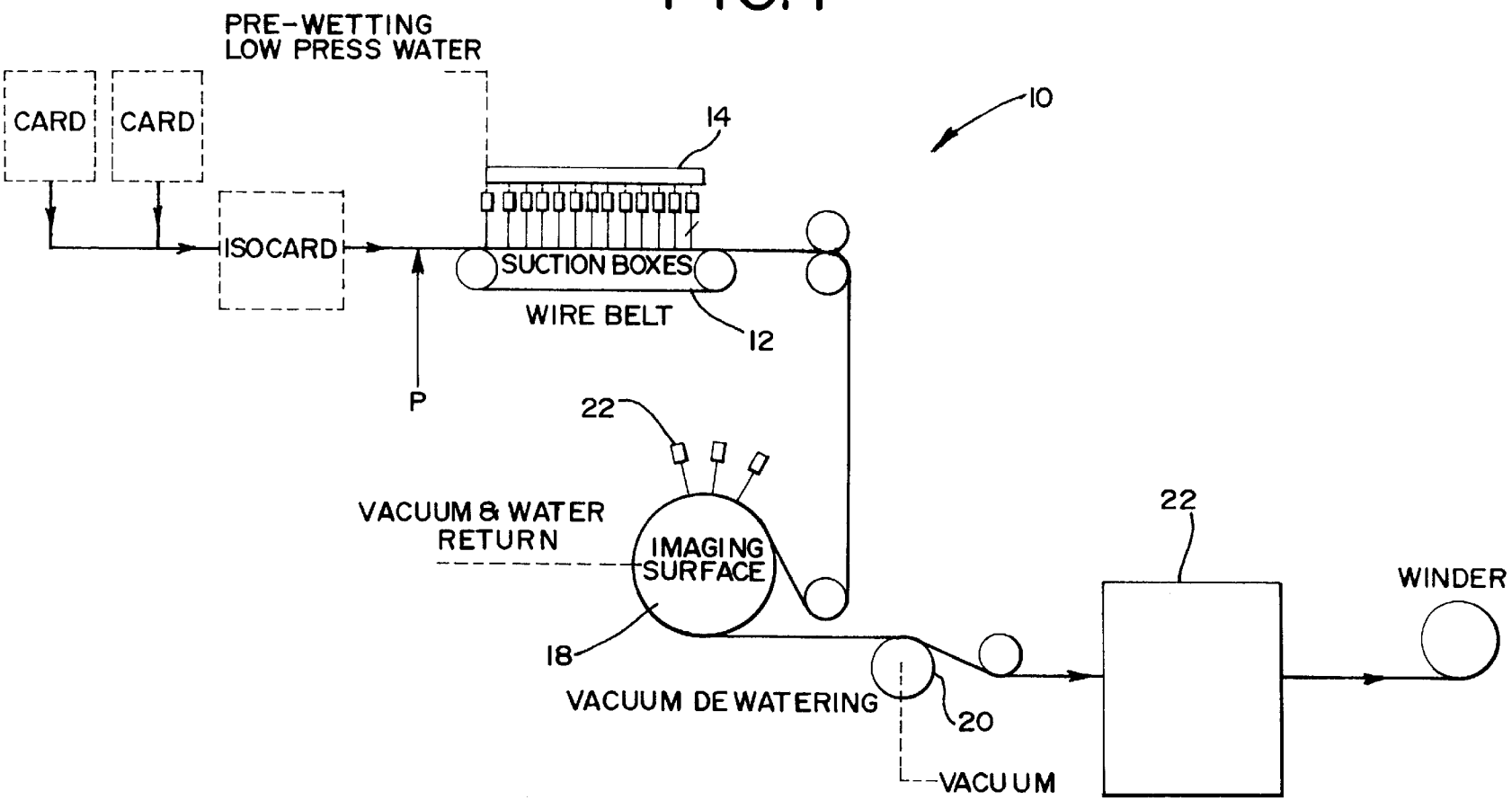
FIG. 1 is a diagrammatic view of a hydroentangling apparatus for practicing the process of the present invention by which a durable, imaged nonwoven fabric is formed.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to FIG. 1, therein is illustrated a hydroentangling apparatus, generally designated 10, which can be employed for practicing the process of the present invention for manufacture of a durable, jet-dyed imaged nonwoven fabric. The apparatus is configured generally in accordance with the teachings of U.S. Pat. No. 5,098,764, to Drelich et al., hereby incorporated by reference. The apparatus 10 includes an entangling belt 12 which comprises a hydroentangling device having a foraminous forming surface upon which hydroentangling of a precursor web P, for effecting consolidation and integration thereof, is effected for formation of the present nonwoven fabric. The precursor web P is then hydroentangled and imaged on a three-dimensional image transfer device (ITD) at drum 18 under the influence of high pressure liquid streams (water) from manifolds 22.

In accordance with the present invention, at least a portion of the fiber or filament web consists of thermally fusible fibers, also called binder fibers, most preferably bicomponent fibers, that are activated through drying or heat setting steps that follow the imaging step. This blend of fusible fibers with the other fibers of the web provides for the subsequent thermal bonding of the fibers in the matrix. The result is an enhancement of the mechanical stability of the preferred spatial arrangement of the entangled fibers which result from the hydroentangling and imaging steps. This enhanced stability provides an entangled web with high durability such that the fabrics thus produced are capable of withstanding commercial dye house processing without deleterious effects on physical and aesthetic properties. Further, these fabrics, either before or after dyeing, exhibit softness and drapeability that is superior to similarly entangled and imaged fabrics that are stabilized by the application of a chemical binder system.

As will be appreciated, the thermoplastic fusible fiber has a melt temperature less than the melt temperature or the decomposition temperature of the base fiber. The fusible fiber is selected from the group consisting of polyamide homopolymers, polyamide co-polymers, polyamide derivatized polymers, and combinations thereof. Alternatively, the fusible fiber is selected from the group consisting of polyester homopolymers, polyester co-polymers, polyester derivatized polymers, and combinations thereof. The base fiber is selected from the group consisting of natural fibers, thermoplastic fibers, thermoset fibers, and combinations thereof. The thermoplastic fiber can be polyester, while the natural fiber can be rayon.

Referring again to FIG. 1, subsequent to the hydroentanglement, the entangled and imaged web can be dewatered, as generally illustrated at 20, with the temperature of the web then elevated by heated air, such as by use of an oven or dryer 22. The temperature of the web can be elevated by heated surface contact, such as by use of steam cans. Elevation of the web temperature to the melting point of the fusible fibers or fusible component of the bicomponent fusible fibers acts to thermally bond the fibers of the matrix together and thus secure the preferred arrangement of the fibers in the entangled and imaged web.

After the heat setting step, a soft, durable, entangled and imaged nonwoven fabric is provided, which is suitable for further textile finishing. The fabric may be dyed, printed or finished by other techniques and used in apparel, home furnishing, upholstery or any number of applications. Notably, wash durability, pill-resistance and drape characteristics of sample fabrics, described hereinafter, meet the requirements for "top of bed" applications, that is, applications for home use such as comforters, pillows, dust ruffles, and the like.

For each of the tested samples, a precursor web was formed by carding the blend of fibers in the specified ratio. Each precursor web was subjected to high pressure water jets prior to imaging for consolidating and integrating the precursor web, with the pre-imaging entanglement being effected with four manifolds at 14, each with three strips of orifices. The orifices were uniformly 0.005 inches in diameter and 50 orifices per inch of strip length. The entangling manifolds were operated at 100, 300, 600 and 800 psi, sequentially.

Imaging was accomplished at imaging drums 18 using a three dimensional image transfer device and a series of three manifolds 22 with 0.0047 inch diameter orifices spaced at 43 orifices per inch. Each of the three manifolds was operated at 2800 psi. The overall line speed was 60 feet per minute.

The entangled and imaged web of each of the tested fabrics was dewatered and thereafter dried and heat set at a temperature satisfactory to melt the lower melting point component of the fusible fibers. For example, the temperature used to heat set nylon bicomponent fiber samples was in the range of about 216° C., and for polyester/copolyester fusible fiber samples was in the range of about 130° C. The heat setting step is accomplished at process speeds compatible with the entangling and patterning process such that the drying and heat setting step would be in a continuous process with the rest of the manufacturing steps. The heat setting step acts to enhance the mechanical stability of the preferred spatial arrangement of the entangled fibers in the web, thereby providing the high degree of durability required for the final commercial dyeing process.

After heat setting, the resultant fabrics exhibit sufficient durability to withstand commercial dye house processing, such as exemplified by jet-dyeing, such as in a jet dyeing apparatus. A jet-dyeing apparatus can be configured in accordance with known arrangements, such as exemplified by U.S. Pat. No. 3,966,406, hereby incorporated by reference. In general, jet-dye processing consists of a high-temperature, piece-dyeing machine that circulates the dye liquor through a Venturi jet, thus imparting a driving force to move the fabric through the process. Speeds of 80 to 300 meters per minute are standard for this type of operation. The fabric is totally immersed in the dye bath which is contained in the closed dye vessel, such that the process is discontinuous from the rest of the manufacturing process described for the present invention.

EXAMPLES

Example 1

Figure 2:
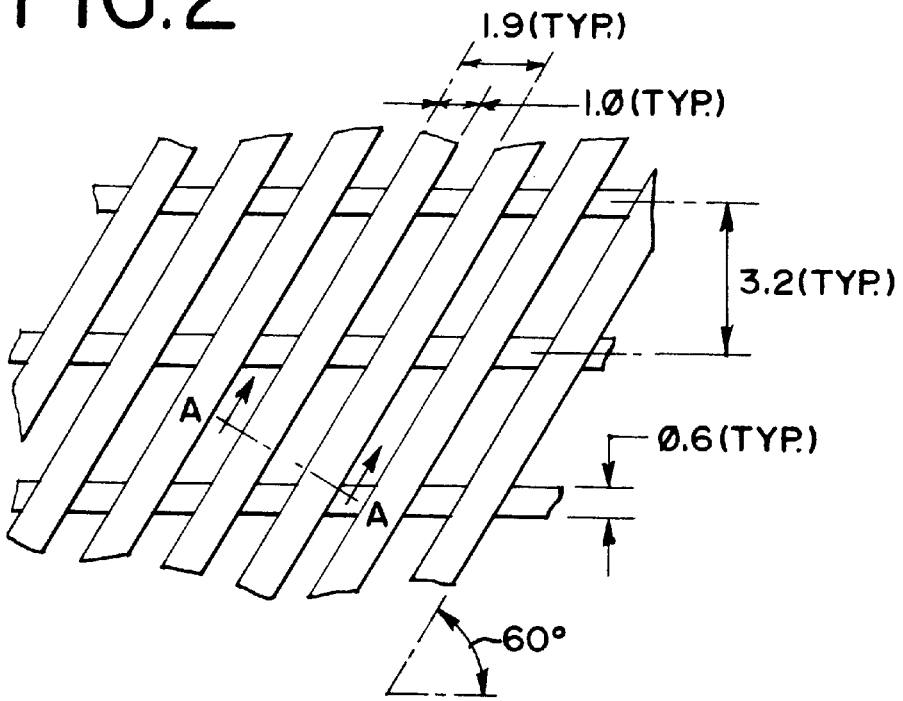
FIG. 2 is an illustration of the features of a three-dimensional image transfer device which can be employed in the apparatus of FIG. 1 for practicing the present invention.
Figure 2A:
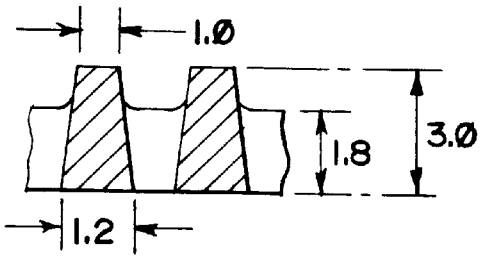
FIG. 2*a* is a view taken along lines A—A of FIG. 2.
Figure 2B:
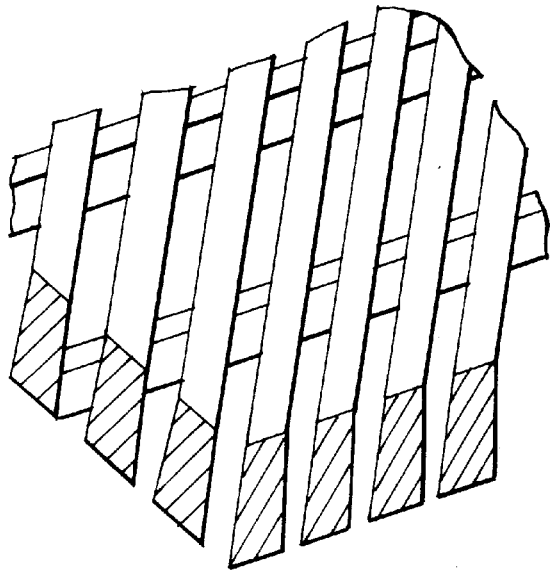
FIG. 2*b* is an isometric view of the features illustrated in FIG. 2.

An imaged nonwoven fabric having a before dyeing-basis weight of three-ounces per square yard was prepared using a fiber blend of 90 percent weight of base fiber to 10 weight percent fusible fiber. Base fibers utilized were Wellman 472, 1.2 denier polyester staple fibers. The heat fusible fibers were obtained from Dupont de Nemours as Type 3100 nylon bicomponent fibers. Type 3100 is a sheath/core bicomponent fiber where the core is nylon 6,6 and the sheath is nylon 6. The material fabricated in this example utilized an entangling drum 12 in the form of "left hand twill" as depicted in FIG. 2. A heat setting temperature of 216° C. was suitable for fabrics containing this fusible fiber. In the course of preparation of samples of the present fabric, it was discovered that a heat-setting temperature more than about 10% above the recommended temperature resulted in undesirable stiffness.

Example 2

An imaged nonwoven fabric made in accordance with Example 1, wherein the alternative a blend ratio of 75 percent weight base fiber and 25 percent weight fusible fiber were employed.

Example 3

An imaged nonwoven fabric made in accordance with Example 1, wherein the alternative a blend ratio of 50 percent weight base fiber and 50 percent weight fusible fiber were employed.

Example 4

An imaged nonwoven fabric having a before dyeing-basis weight of three-ounces per square yard was prepared using a fiber blend of 90 percent weight of base fiber to 10 weight percent fusible fiber. The base fiber for this blend was comprised of a Wellman 472, a 1.2 denier polyester staple fiberand the fusible fiber was a Wellman 712P, a sheath/core copolyester/polyester bicomponent fiber. A heat setting temperature of 130° C. was suitable for fabrics containing this fusible fiber., Steam dry cans were set at 130° C. for drying and heat setting the fabrics after entangling and imaging, as illustrated in FIG. 1 and utilizing an entangling drum 12 as depicted in FIG. 2.

Example 5

An imaged nonwoven fabric made in accordance with Example 4, wherein the alternative a blend ratio of 75 percent weight base fiber and 25 percent weight fusible fiber were employed.

Example 6

An imaged nonwoven fabric made in accordance with Example 4, wherein the alternative a blend ratio of 50 percent weight base fiber and 50 percent weight fusible fiber were employed.

Example 7

Figure 3:
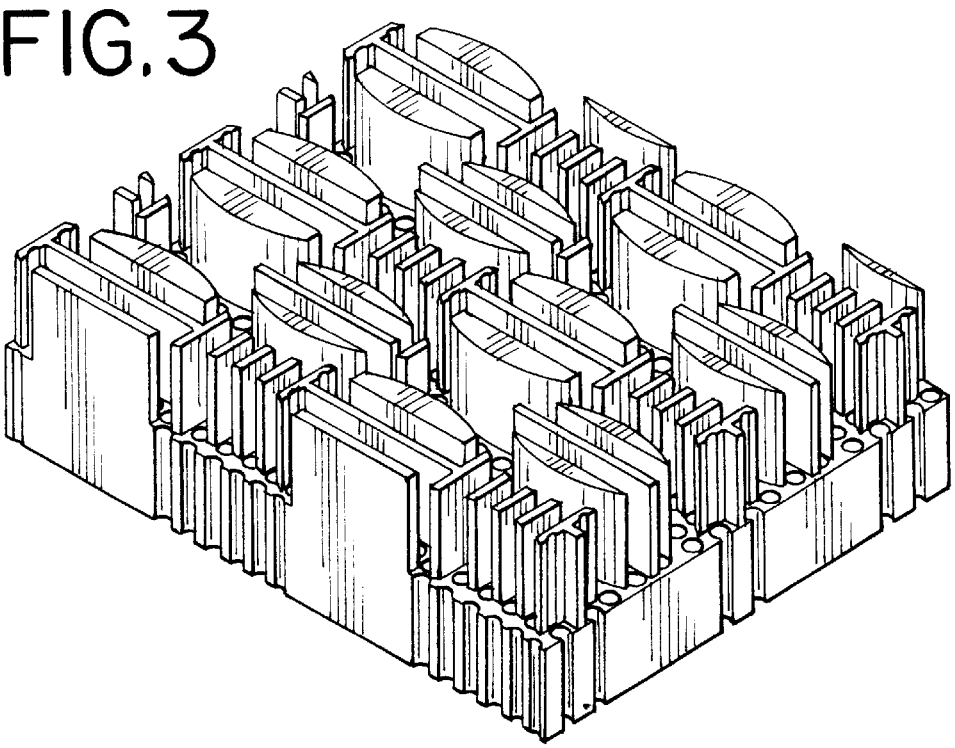
FIG. 3 is an isometric illustration of the features of a three-dimensional image transfer device which can be employed in the apparatus of FIG. 1 for practicing the present invention.
Figure 3A:
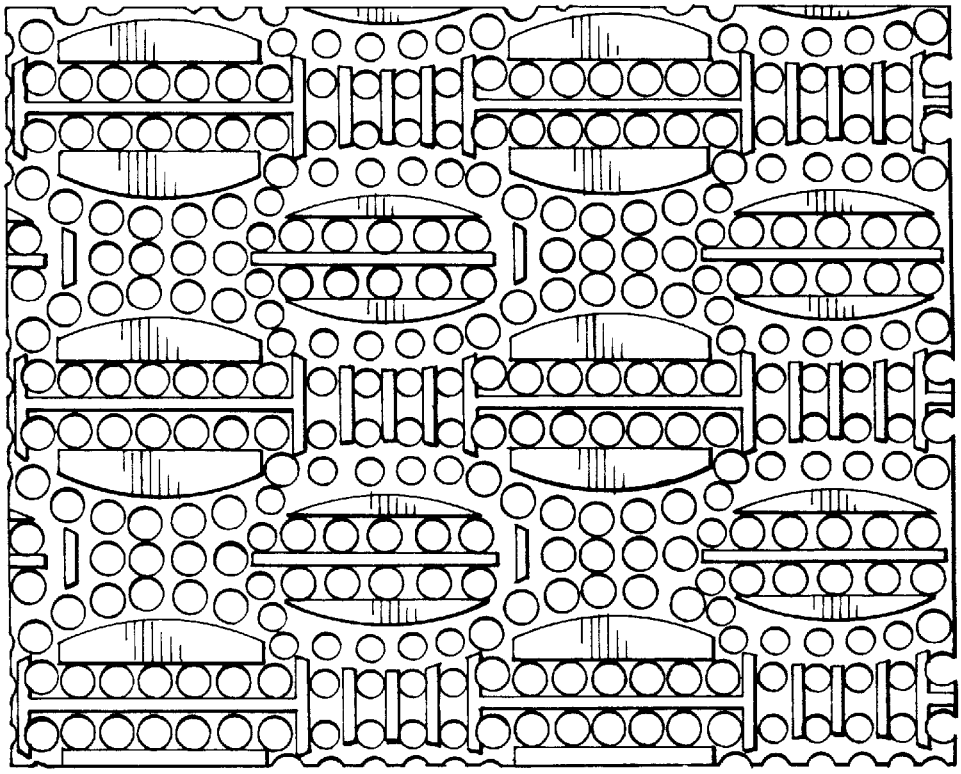
FIG. 3*a* is a plan view of the features shown in FIG. 3.

An imaged nonwoven fabric made in accordance with Example 1, wherein the alternative a blend ratio of 85 percent weight base fiber and 15 percent weight fusible fiber were employed on a image transfer device having a patterned termed "pique" and depicted in FIG. 3.

Example 8

Figure 4:
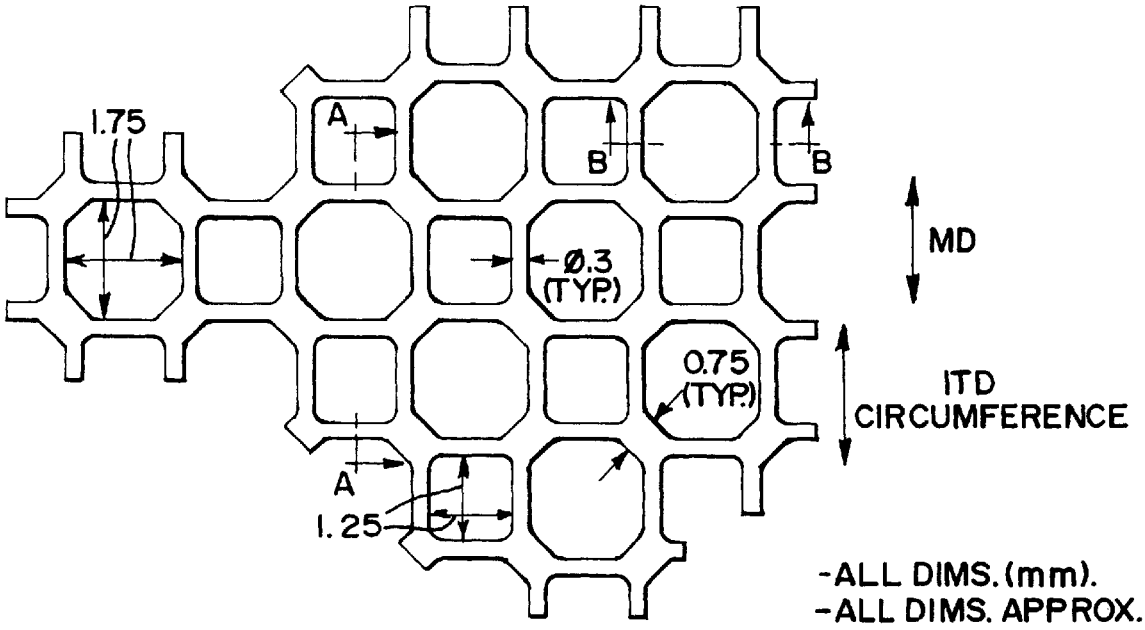
FIG. 4 is an illustration of the features of a three-dimensional image transfer device which can be employed in the apparatus of FIG. 1 for practicing the present invention.
Figure 5:
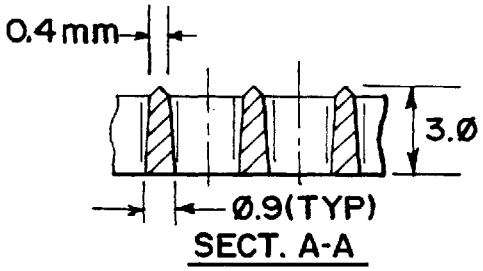
FIG. 5 is a view taken along lines A—A of FIG. 4.
Figure 6:
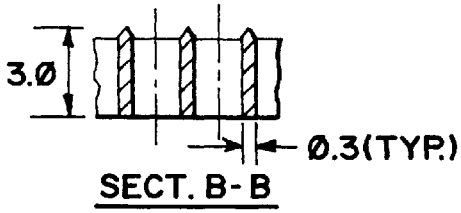
FIG. 6 is a view taken along lines B—B of FIG. 4.
Figure 7:
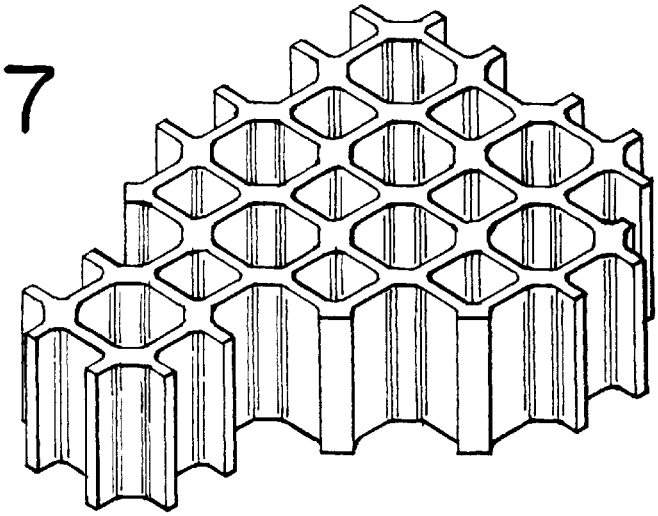
FIG. 7 is an isometric illustration of the features shown in FIG. 4.
Figure 8:
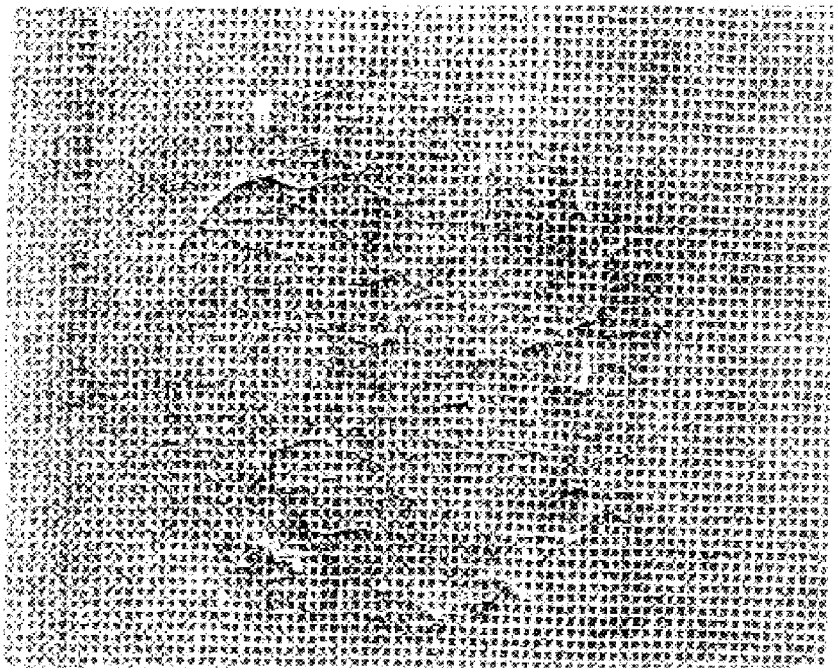
FIG. 8 is plan view of an imaged nonwoven fabric of the present invention after Brush Pill testing.
Figure 9:
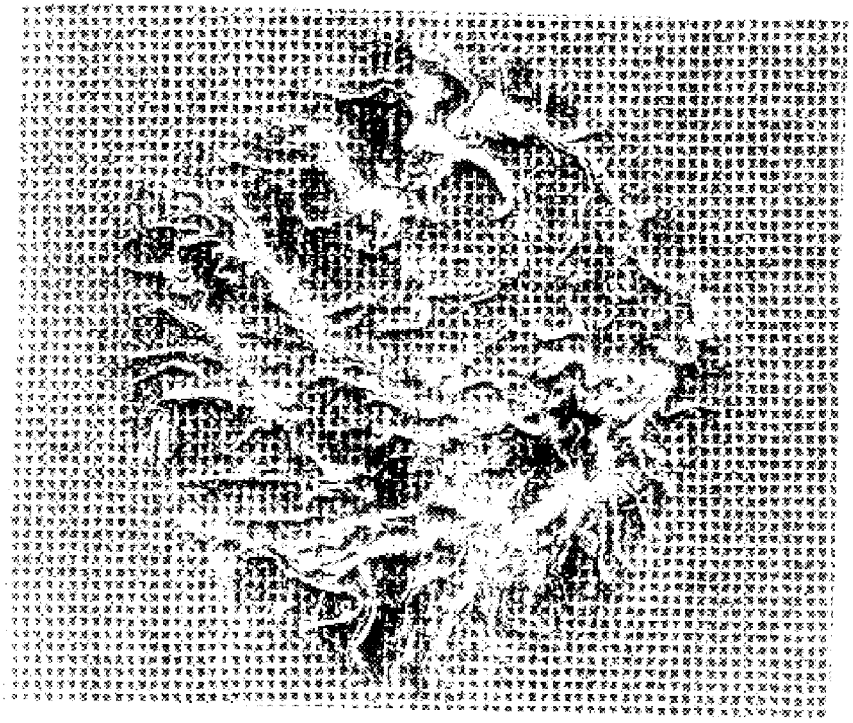
FIG. 9 is plan view of an imaged nonwoven fabric of the present invention without activation of the fusible fiber component, after Brush Pill testing.
Figure 10:
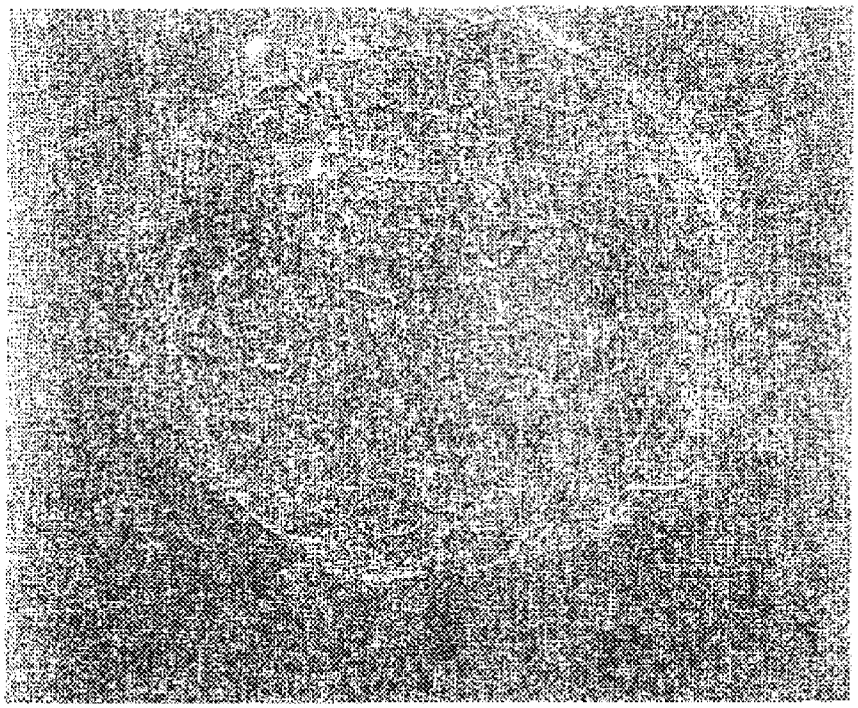
FIG. 10 is plan view of an imaged nonwoven fabric of the present invention after Brush Pill testing.
Figure 11:
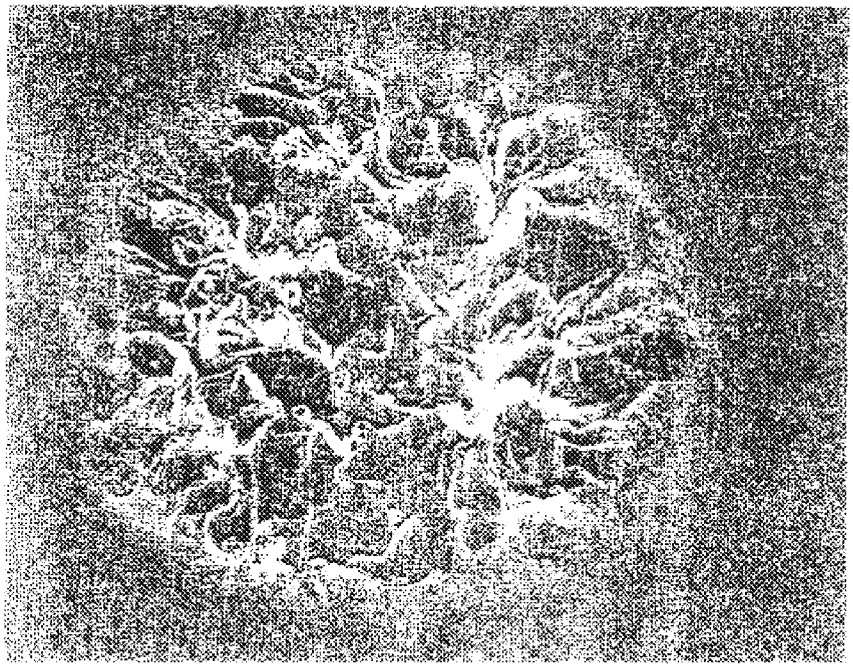
FIG. 11 is plan view of an imaged nonwoven fabric of the present invention without activation of the fusible fiber component. after Brush Pill testing.

An imaged nonwoven fabric made in accordance with Example 1, wherein the alternative a blend ratio of 85 percent weight base fiber and 15 percent weight fusible fiber were employed on an image transfer device having a patterned termed "octagon and square" and depicted in FIG. 4.

Example 9

An imaged nonwoven fabric made in accordance with Example 1, wherein the alternative a blend ratio of 85 percent weight base fiber and 15 percent weight fusible fiber were employed on a image transfer device having a pattern termed "20×20", which refers to a rectilinear forming pattern having 20 lines per inch by 20 lines per inch configured in accordance with FIGS. 12 and 13 of U.S. Pat. No. 5,098,764, except mid-pyramid drain holes were omitted. Drain holes are present at each corner of the pyramids (four holes surrounded each pyramid). The "20×20" pattern is oriented 45 degrees relative to the machine direction, with a pyramidal height of 0.025 inches and drain holes having a diameter of 0.02 inches.

Example 10

An imaged nonwoven fabric having a before dyeing-basis weight of 3.5 ounces per square yard was prepared using a fiber blend of 85 percent weight of base fiber to 15 weight percent fusible fiber. The base fiber for this blend was comprised of an "ECHOSPUN" Wellman recycled PET fiber of 1.8 denier and the fusible fiber was a KOSA 252, a sheath/core copolyester/polyester bicomponent fiber of 3.0 denier. The entangling drum 12 used was provided with a pattern referred to as "12×12", which refers to a rectilinear forming pattern having 12 lines per inch by 12 lines per inch configured in accordance with FIGS. 12 and 13 of U.S. Pat. No. 5,098,764, except mid-pyramid drain holes are omitted. A heat setting temperature of 184° C. was suitable for fabrics containing this fusible fiber, using a through-air drier as depicted at 22 in FIG. 1.

Example 11

An imaged nonwoven fabric made in accordance with Example 10, wherein the alternative the imaged nonwoven fabric was not subjected to elevated temperature, and therefore the fusible fiber was not activated.

Example 12

An imaged nonwoven fabric having a before dyeing-basis weight of 3.0 ounces per square yard was prepared using a fiber blend of 85 percent weight of base fiber (the base fiber itself comprised of a blend of 59 weight percent "MODAL" Lenzing high-modulus rayon of 1.5 denier to 41 weight percent Wellman 472, a 1.2 denier polyester staple fiber) to 15 weight percent fusible fiber. The fusible fiber was a KOSA 252, a sheath/core copolyester/polyester bicomponent fiber of 3.0 denier. The entangling drum 12 used was in a configuration referred to as "33×28", which refers to a rectilinear forming pattern having 33 lines per inch by 28 lines per inch configured in accordance with FIGS. 12 and 13 of U.S. Pat. No. 5,098,764, except mid-pyramid drain holes are omitted. A heat setting temperature of 190° C. was suitable for fabrics containing this fusible fiber, using a through-air drier as is commercially available.

Example 13

An imaged nonwoven fabric made in accordance with Example 12, wherein the alternative the imaged nonwoven fabric was not subjected to elevated temperature, and therefore the fusible fiber was not activated.

Samples 4 and 5 were found to be soft and drapeable. Sample 6, containing 50 weight percent of the fusible fiber was stiff. This was attributed to the higher content of the polyester fusible fiber.

As shown in Table 1, Examples 1, 2, 3, and 4 (Samples 1 to 4) were successfully jet dyed after heat setting then tested for appearance after repeated home launderings as per test protocol AATCC 124-1996. No application of chemical binders was required to obtain the positive results. These examples were also tested under protocol Federal Test Method 191A, Method 5206, "Stiffness of Cloth, Drape and Flex, Cantilever Bending Method", the results provided in Table 2. Table 3 presents standard ASTM fabric quality test results for Examples 7 through 9 (Samples 7 to 9). Examples 10 through 13 were tested under ASTM D3511-82 for abrasion resistance. The results of activating the fusible fiber versus not activating the fusible fiber are shown in FIGS. 8 through 11. Example 10, depicted in FIG. 8, and Example 12 depicted in FIG. 10, both exhibits the reduction in pilling caused by abrasion against a high friction surface. Example 11, depicted in FIG. 9, and Example 13, depicted in FIG. 11, which are the corresponding imaged nonwoven fabrics whereby the fusible fiber is not activated, shows that significant abrasion and loss of image quality are apparent.

TABLE 1

| Sample ID | 1st Wash Cycle | 5th Wash Cycle |
|---|---|---|
| 1 | 3.5 | 3.5 |
| 2 | 3.5 | 3.5 |
| 3 | 3 | 5 |
| 4 | 3 | 5 |

TABLE 2

| Sample 1 | | Sample 2 | | Sample 3 | | Sample 4 | |
|---|---|---|---|---|---|---|---|
| Length | Width | Length | Width | Length | Width | Length | Width |
| 9.1 | 4.9 | 10.7 | 5.7 | 9.3 | 4.2 | 9.3 | 4.7 |
| 8.3 | 4.7 | 11.2 | 6.2 | 9.1 | 4.2 | 9.7 | 5.0 |
| 8.5 | 4.7 | 11.5 | 6.2 | 8.7 | 4.3 | 9.1 | 4.9 |
| 8.2 | 4.8 | 11.8 | 6.5 | 9.5 | 4.3 | 9.1 | 4.8 |
| 8.0 | 4.6 | 10.7 | 6.5 | 9.1 | 3.8 | 9.3 | 4.8 |
| 8.4 | 4.7 | 11.2 | 6.2 | 9.1 | 4.2 | 9.3 | 4.8 |
| average | average | average | average | average | average | average | average |

TABLE 3

| Test Sample | Basis Weight | Brush Pill Rating | Tensile-MC | Tensile-CD | Elongation-MD | Elongation-CD |
|---|---|---|---|---|---|---|
| Sample 7 - Before Fusible Activation | 3.70 | 1 | 64.7 | 47.3 | 67.5 | 109.3 |
| Sample 7 - After Fusible Activation | 3.89 | 3 | 72.6 | 46.6 | 39.2 | 115.9 |
| Sample 8 - Before Fusible Activation | 3.48 | 1 | 69.1 | 50.8 | 75.1 | 130.1 |
| Sample 8 - After Fusible Activation | 3.53 | 3 | 70.8 | 48.2 | 41.6 | 118.3 |
| Sample 9 - Before Fusible Activation | 2.37 | 1 | 48.5 | 24.4 | 53.0 | 132.2 |
| Sample 9 - After Fusible Activation | 2.71 | 4 | 52.9 | 20.5 | 41.6 | 123.1 |

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A process for making a highly durable, hydroentangled nonwoven fabric, consisting of the steps of;

a) providing a nonwoven first fibrous matrix comprising a blend of thermoplastic fusible fibers and base fibers, b) providing a nonwoven second fibrous matrix comprising a blend of thermoplastic fusible fibers and base fibers, wherein said base fibers of said first and second fibrous matrices are selected from the group consisting of thermoplastic and rayon fibers, c) layering one or more first fibrous matrices with one or more second fibrous matrices, wherein the thermoplastic fusible fibers of said first and second fibrous matrices have a melt temperature less than the melt temperature or the decomposition temperature of the base fibers of said fibrous matrices, d) consolidating only the layered fibrous matrices into a precursor web, e) hydroentangling the precursor web into a nonwoven fabric using a three-dimensional image transfer device, the three-dimensional image transfer device imparting the layered fibrous matrices into a three-dimensional spatial arrangement, said hydroentangling step being effected prior to thermal-bonding of said thermoplastic fusible fibers, f) elevating the temperature of the imaged nonwoven fabric subsequent to said hydroentangling step such that said fusible fibers are softened or melted and act to thermally bond the fusible fibers and base fibers of the fibrous blend together, thus securing the three-dimensional spatial arrangement of the fibrous matrices.

2. A process according to claim 1, wherein the thermoplastic fusible fiber is selected from the group consisting of polyamide homopolymers, polyamide co-polymers, polyamide derivatized polymers and combinations thereof.

3. A process according to claim 1, wherein the thermoplastic fusible fiber is selected from the group consisting of polyesters homopolymers. polyester co-polymers, polyester derivatized polymers and combinations thereof.

4. A process according to claim 1, wherein the thermoplastic fiber is polyester.

5. A process according to claim 1, wherein the means for elevating temperature of the imaged nonwoven fabric is by heated air.

6. A process according to claim 1, wherein the means for elevating temperature of the imaged nonwoven fabric is by heated surface contact.

7. A process according to claim 1, wherein said consolidating step is effected by hydroentanglement.

* * * * *